US008987619B2

(12) United States Patent
Bodenmeier et al.

(10) Patent No.: US 8,987,619 B2
(45) Date of Patent: Mar. 24, 2015

(54) TERMINAL ASSEMBLY FOR A POWER SWITCH IN TENSION SPRING TECHNOLOGY

(75) Inventors: Martin Bodenmeier, Parkstein (DE); Ayhan Kezer, Kümmersbruck (DE); Eugen Mayer, Sulzbach-Rosenberg (DE)

(73) Assignee: Siemens Aktiengesellschaft, Munich (DE)

( * ) Notice: Subject to any disclaimer, the term of this patent is extended or adjusted under 35 U.S.C. 154(b) by 133 days.

(21) Appl. No.: 13/810,745

(22) PCT Filed: Jun. 30, 2011

(86) PCT No.: PCT/EP2011/061065

§ 371 (c)(1),
(2), (4) Date: Jan. 17, 2013

(87) PCT Pub. No.: WO2012/013442

PCT Pub. Date: Feb. 2, 2012

(65) Prior Publication Data

US 2013/0118868 A1 May 16, 2013

(30) Foreign Application Priority Data

Jul. 28, 2010 (DE) ..... 10 2010 032 522

(51) Int. Cl.

| | |
|---|---|
| ***H01H 9/20*** | (2006.01) |
| ***H01H 9/28*** | (2006.01) |
| ***H01R 9/24*** | (2006.01) |
| *H01H 71/08* | (2006.01) |
| *H01R 13/506* | (2006.01) |
| *H01H 71/02* | (2006.01) |

(52) U.S. Cl.

CPC ..... *H01H 9/285* (2013.01); *H01R 9/2416* (2013.01); *H01H 71/08* (2013.01); *H01R 13/506* (2013.01); *H01H 71/0228* (2013.01)

USPC ..... 200/50.28

(58) Field of Classification Search

USPC ..... 200/50.28, 50.01, 333, 334; 439/521, 439/367, 810, 901, 701

See application file for complete search history.

(56) References Cited

U.S. PATENT DOCUMENTS

| | | | | |
|---|---|---|---|---|
| 5,662,491 | A | 9/1997 | Antilla et al. | |
| 6,663,441 | B1 * | 12/2003 | Alexandre et al. | 439/715 |
| 6,767,242 | B2 * | 7/2004 | Feller et al. | 439/521 |

(Continued)

FOREIGN PATENT DOCUMENTS

| | | | |
|---|---|---|---|
| CN | 1689128 | A | 10/2005 |
| CN | 101138061 | A | 3/2008 |

(Continued)

OTHER PUBLICATIONS

Chinese Office Action dated Oct. 22, 2014, issued in Chinese Application No. 2011800367640 with English translation.

(Continued)

*Primary Examiner* — Edwin A. Leon

(74) *Attorney, Agent, or Firm* — Harness, Dickey & Pierce, P.L.C.

(57) ABSTRACT

A terminal assembly for a power switch for electrical contact to terminal points which are designed to receive electrical lines. The terminal assembly of at least one embodiment is arranged on a tension-spring-based power switch.

8 Claims, 2 Drawing Sheets

(56) References Cited

U.S. PATENT DOCUMENTS

| | | | | |
|---|---|---|---|---|
| 7,586,052 | B2 | 9/2009 | Adunka et al. | |
| 7,609,137 | B2 | 10/2009 | Roesner et al. | |
| 7,609,528 | B2 | 10/2009 | Freimuth et al. | |
| 2003/0068923 | A1 | 4/2003 | Feller et al. | |
| 2009/0260964 | A1 | 10/2009 | Orban et al. | |
| 2010/0081343 | A1* | 4/2010 | Bodenmeier | 439/715 |

FOREIGN PATENT DOCUMENTS

| | | | |
|---|---|---|---|
| DE | 10301003 | B3 | 9/2004 |
| DE | 202005003820 | U1 | 5/2005 |
| DE | 102004042427 | A1 | 11/2007 |
| DE | 102006049772 | A1 | 4/2008 |
| DE | 102007016658 | A1 | 10/2008 |
| EP | 0592336 | A1 | 4/1994 |
| EP | 1296340 | A1 | 3/2003 |
| EP | 1856709 | A1 | 11/2007 |
| EP | 2093787 | A1 | 8/2009 |
| JP | 2006236722 | A | 9/2006 |
| WO | WO 2006094959 | A1 | 9/2006 |
| WO | WO-2008113397 | A1 | 9/2008 |

OTHER PUBLICATIONS

International Search Report PCT/ISA/210 for International Application No. PCT/EP2011/061065 dated Sep. 22, 2011.

German Search Report for German Patent Publication No. 10 2010 032 522.8 dated Feb. 11, 2011.

* cited by examiner

TERMINAL ASSEMBLY FOR A POWER SWITCH IN TENSION SPRING TECHNOLOGY

PRIORITY STATEMENT

This application is the national phase under 35 U.S.C. §371 of PCT International Application No. PCT/EP2011/061065 which has an International filing date of Jun. 30, 2011, which designated the United States of America, and which claims priority to German patent application number DE 102010032522.8 filed Jul. 28, 2010, the entire contents of each of which are hereby incorporated herein by reference.

FIELD

At least one embodiment of the invention generally relates to a terminal assembly for a power switch for electrical contact to terminal points which are designed to receive electrical lines.

BACKGROUND

A terminal assembly of this type, which is to be attached to a housing of an electrical device, establishes an electrical connection between the interior of the electrical device and the periphery. In particular sensors, actuators and also a device power supply, which is embodied for instance as a switching device, can be connected in this way.

There are two basic types of terminal. One basic type is the screw-type terminal, in which an electrical line to be connected is introduced by hand into the terminal point, held there and a terminal screw is tightened with another hand. The other basic type of terminal is the tension spring terminal, in which a tool, for instance a screwdriver, is pushed into an unlocking opening with the one hand, in order with the other hand to introduce an electrical line to be attached into the thus unlocked terminal point and to hold it there until the terminal point has deployed its spring terminal effect after removal of the tool from the unlocking opening. With both types of basic terminal, the consecutive working steps "assembling" and "fixing" are therefore always required.

A large number of terminal points is often required, so that they cannot all be to arranged adjacent to one another in the direction of a terminal or housing width. There are therefore multistory terminal units having several terminal series arranged above and at least partially also behind one another in the manner of steps. With such multi-storey terminal units, the space requirement in terms of both the housing exterior and also the housing interior is relatively high. There is thus less space available for other function elements within the housing of the electrical device, such as for instance in accordance with assembled printed circuit boards.

Power switches used in domestic and industrial installations are normally equipped with outlet and feed terminals, which are arranged in terminal receptacles embodied for this purpose on both sides of the housing. The outlet and feed terminals are connected electrically to the assigned terminal paths of the power switch. The electrical connection between an external circuit to be protected and the outlet terminals or the connection between the feed network and the feed terminals is made by terminal screws which are arranged in the upper part of the said terminal. These screws generally comprise an end group, which serves to guide the screw against the conductor of the relevant circuit when the screw is tightened, so that this conductor is rigidly clamped between the screw and the associated terminal lug.

Demands are placed on certain elements in the power switch such that these have a one inch air gap and a two inch creepage distance on the entry side. In screw-type devices, this was previously realized by an additional terminal, like for instance an E-type terminal. For power switches based on tension spring, there was previously no simple and economical solution.

SUMMARY

At least one embodiment of the present invention is directed to a terminal assembly for power switches based on tension spring technology, which fulfils the desired requirements.

Advantageous embodiments and developments, which can be used individually or in combination with one another, form the subject matter of the dependent claims.

According to at least one embodiment of the invention, a terminal assembly is disclosed for a power switch for electrical contact with terminal points, which are embodied to receive electrical lines. The terminal assembly is arranged on a tension-spring-based power switch. The terminal assembly is preferably embodied as a plastic part in the form of an attachment part in power switches based on tension spring technology.

BRIEF DESCRIPTION OF THE DRAWINGS

Further advantages and embodiments of the invention are explained in more detail below with the aid of example embodiments and with the aid of the drawing, in which shown schematically are FIG. 1 a perspective representation of an embodiment of an inventive terminal assembly as an individual component.

DETAILED DESCRIPTION OF THE EXAMPLE EMBODIMENTS

The terminal assembly of at least on embodiment has a preferably L-shaped base body having a longer and a shorter limb. Three through-openings are preferably arranged on the longer limb, which are arranged above the blow-out opening of the three different current paths of the power switch. Two angled latching hooks are preferably arranged at the end of the longer limb, which engage in latching openings of the power switch which are provided herefor. Three line connection openings for connecting electrical lines are preferably provided on the shorter limb. Snap-fit hooks aligned inwards toward the power switch are preferably disposed below these line connection openings.

A particularly advantageous embodiment provides that the terminal assembly is fastened to the power switch by way of at least one latching device. These latching devices are preferably partially embodied as latching hooks and as snap-fit hooks. According to the terminal assembly of at least on embodiment, the latching hooks are disposed on the longer limb of the L-shaped terminal assembly and the snap-fit hooks on the short limb of the L-shaped terminal assembly.

Provision is further preferably made for the terminal assembly to be guided by lateral fastening guides on the power switch. Provision is made here according to at least on embodiment of the invention such that the fastening guide on the circuit switch is arranged in recesses on the terminal assembly which are provided herefor, in particular on the longer limb of the L-shaped terminal assembly.

A further advantageous embodiment of the inventive terminal assembly indicates that the terminal assembly comprises phase separating walls. These phase separating walls are arranged on the longer limb of the L-shaped terminal assembly, and preferably delimit three through openings, which are arranged above the blow-out openings of the three different current paths of the power switch. This structural solution enables a defined blow-out of heat from the power switch.

The inventive terminal assembly of at least on embodiment enables the desired parameters for the power switch, which includes a 1 inch air gap and a 2 inch creepage path, now also to be accessible for power switches based on tension spring technology in the form of an attachment part. The solution shown is characterized in particular by cost-effectiveness. In addition, the inventive terminal assembly of at least on embodiment enables a defined blowing-out of the heat from the power switch.

Figure 1:
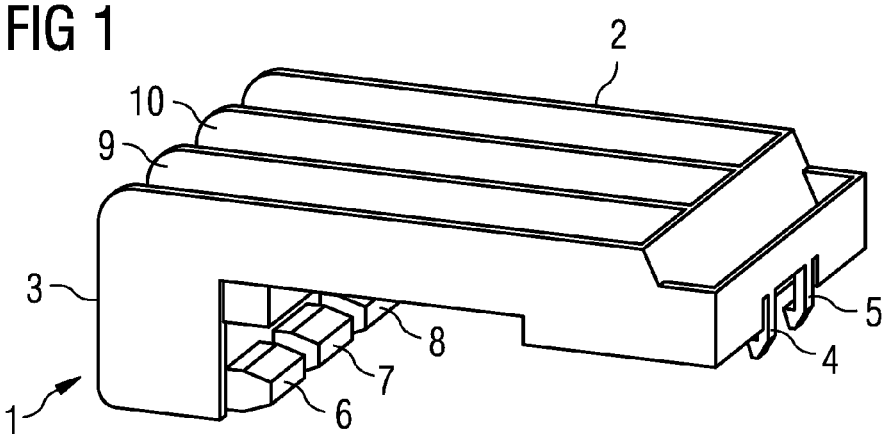

FIG. 1 shows an inventive terminal assembly 1, which preferably comprises an L-shaped base body in the form of an attachment part having a longer limb 2 and a shorter limb 3. Two angled latching hooks 4, 5 are preferably arranged at the end of the longer limb 2, which engage in latching openings of the power switch which are provided herefor. Three snap-fit hooks 6, 7, 8 aligned inwards toward the power switch are preferably arranged on the shorter limb 3. A number of phase separating walls 9, 10 arranged in parallel to one another are disposed above the longer limb 2.

Figure 2:
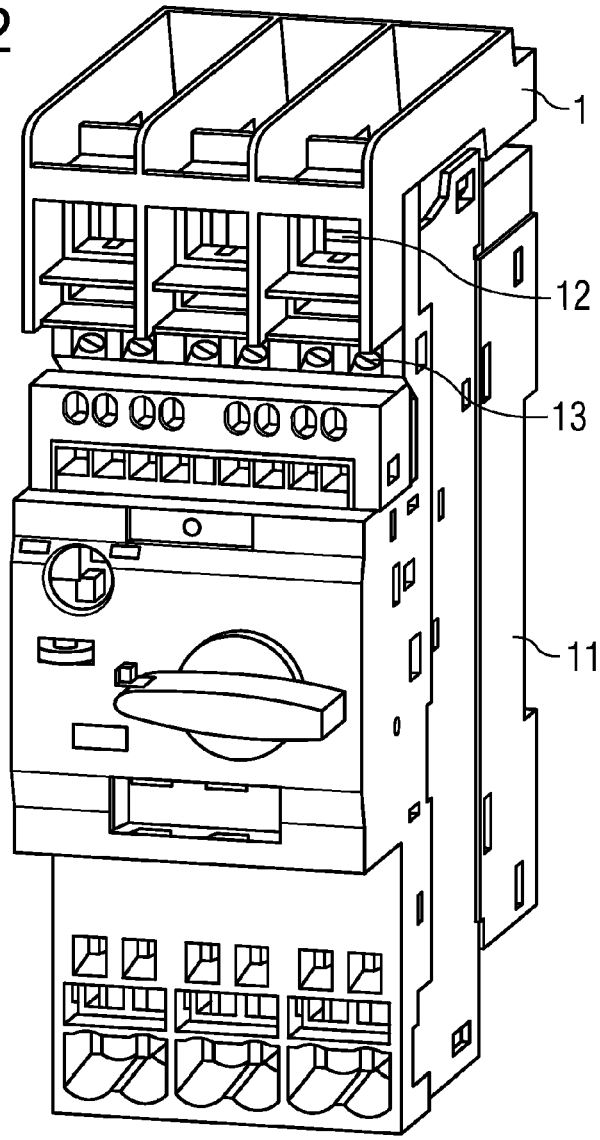
FIG. 2 a perspective representation of an embodiment of the inventive terminal assembly according to FIG. 1 when used on power switches as an attachment part.

FIG. 2 shows an embodiment of the inventive terminal assembly 1 applied to a power switch 11 as an attachment part. The power switch 11 is based here on tension spring technology. FIG. 2 shows that three line connection openings 12 are preferably embodied on the shorter limb 3 for the connection of electrical lines. Terminal actuation openings 13 are arranged below these line connection openings 12 on the power switch 11.

Figure 3:
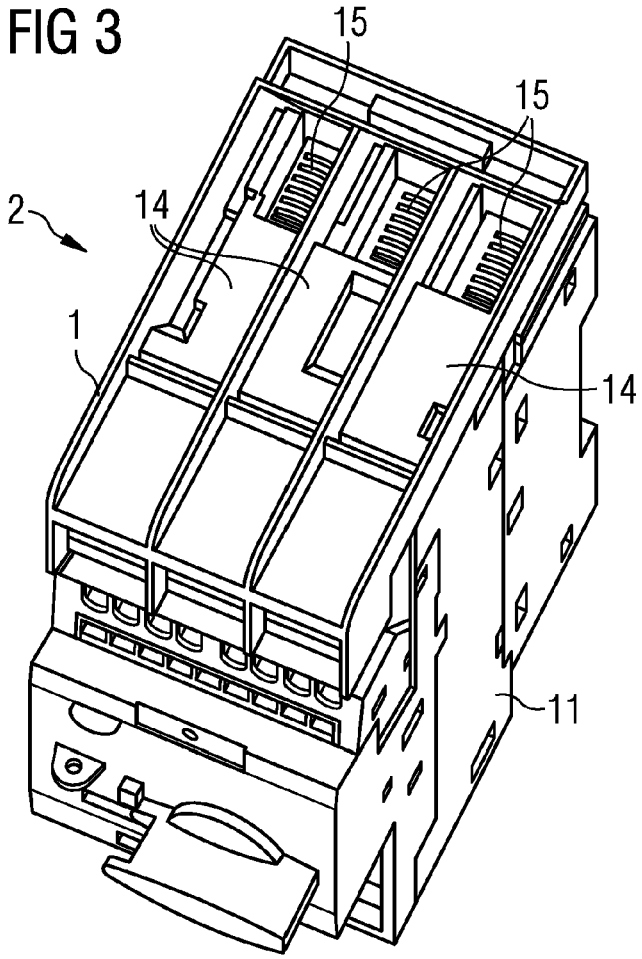
FIG. 3 a perspective representation of the combination of terminal assembly and power switch with a top view onto the terminal assembly.

FIG. 3 likewise discloses the combination of an embodiment of an inventive terminal assembly 1 and power switch 11. Three through openings 14 are preferably arranged on the longer limb 2 of the terminal assembly 1, which are arranged above the blow-out openings 15 of the three different current paths of the power switch 11.

Figure 4:
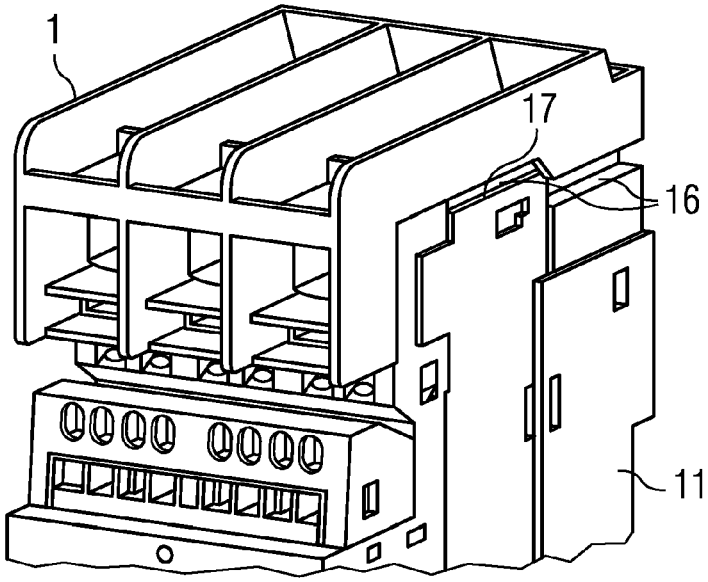
FIG. 4 a perspective representation of the combination of the terminal assembly and power switch from a side view.

The combination shown in FIG. 4 comprising the terminal assembly 1 and the power switch 11 shows lateral fastening guides 16 on the power switch 11, which engage in recesses 17 on the terminal assembly 1 provided therefor.

An embodiment of an inventive terminal assembly enables the desired parameters for the power switch, which includes an 1 inch air gap and a 2 inch creepage path, now also to be accessible for power switches based on tension spring technology in the form of an attachment part. The solution shown is characterized in particular by cost-effectiveness. In addition, the inventive terminal assembly enables a defined blow-out of heat from the power switch.

The invention claimed is:

1. A terminal assembly for a power switch for electrical contact with terminal points, embodied to receive electrical lines, the terminal assembly comprising:

a long limb having a plurality of phase separating walls, wherein the phase separating walls define heat blowout channels; and a short limb extending perpendicularly from the long limb wherein the short limb includes a plurality of partition walls defining line connection openings.

2. The terminal assembly of claim 1, wherein the terminal assembly further comprises snap fit hooks extending from a free end of the short limb in a direction parallel to the long limb.

3. The terminal assembly of claim 1, wherein the terminal assembly further comprises at least two latching hooks extending from a free end of the long limb in a direction parallel to the short limb.

4. The terminal assembly of claim 3, wherein the at least two latching devices are embodied as snap-fit hooks.

5. The terminal assembly of claim 1, wherein the terminal assembly is guided through lateral fastening guides on the power switch.

6. A power switch comprising the terminal assembly of claim 1.

7. The terminal assembly of claim 2, wherein the terminal assembly is guided through lateral fastening guides on the power switch.

8. A power switch comprising the terminal assembly of claim 2.

* * * * *